US010126682B2

(12) United States Patent
Okamoto et al.

(10) Patent No.: US 10,126,682 B2
(45) Date of Patent: Nov. 13, 2018

(54) DEVELOPING DEVICE, AND IMAGE FORMING APPARATUS AND PROCESS CARTRIDGE INCORPORATING SAME

(71) Applicants: Hiroaki Okamoto, Kanagawa (JP); Tatsuya Kubo, Kanagawa (JP); Junichi Matsumoto, Kanagawa (JP); Shinji Tamaki, Tokyo (JP); Ichiro Kadota, Kanagawa (JP)

(72) Inventors: Hiroaki Okamoto, Kanagawa (JP); Tatsuya Kubo, Kanagawa (JP); Junichi Matsumoto, Kanagawa (JP); Shinji Tamaki, Tokyo (JP); Ichiro Kadota, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/687,630

(22) Filed: Aug. 28, 2017

(65) Prior Publication Data

US 2018/0120737 A1 May 3, 2018

(30) Foreign Application Priority Data

Oct. 31, 2016 (JP) ..... 2016-213624

(51) Int. Cl.
*G03G 15/08* (2006.01)

(52) U.S. Cl.
CPC ..... *G03G 15/0889* (2013.01); *G03G 15/0813* (2013.01); *G03G 15/0898* (2013.01)

(58) Field of Classification Search
CPC ..... G03G 15/0889; G03G 15/0887; G03G 15/0898; G03G 15/09; G03G 15/0813
See application file for complete search history.

(56) References Cited

U.S. PATENT DOCUMENTS 4,974,023 A * 11/1990 Aimoto ..... G03G 15/0844 399/119
2012/0201575 A1* 8/2012 Kashimoto ..... G03G 15/0812 399/272
2012/0269544 A1 10/2012 Tsuda et al.
2013/0209142 A1* 8/2013 Kusukawa ..... G03G 15/081 399/274
2014/0205310 A1* 7/2014 Ohashi ..... G03G 15/0812 399/98
2016/0048094 A1* 2/2016 Kusukawa ..... G03G 15/0898 399/274
2016/0062274 A1 3/2016 Kadota et al.
(Continued)

FOREIGN PATENT DOCUMENTS

JP 6-059550 3/1994
JP 8-062976 3/1996
(Continued)

*Primary Examiner* — Sophia S Chen
(74) *Attorney, Agent, or Firm* — Harness, Dickey & Pierce, P.L.C.

(57) ABSTRACT

A developing device includes a casing to contain developer, a developer bearer disposed in the casing and opposite a latent image bearer in a developing range, at least one developer contact face to which the developer adheres in image formation, and a vibrator to give vibration to the developer contact face in a non-image formation period. The developer bearer is to rotate to supply the developer to the latent image bearer in the developing range.

10 Claims, 9 Drawing Sheets

(56) References Cited

U.S. PATENT DOCUMENTS

| | | | |
|---|---|---|---|
| 2016/0170329 | A1 | 6/2016 | Kimura et al. |
| 2016/0202630 | A1 | 7/2016 | Okamoto et al. |
| 2016/0202660 | A1 | 7/2016 | Terai et al. |

FOREIGN PATENT DOCUMENTS

| | | |
|---|---|---|
| JP | 2005-201943 | 7/2005 |
| JP | 2005-352076 | 12/2005 |
| JP | 2012-226191 | 11/2012 |
| JP | 2015-194676 | 11/2015 |

* cited by examiner

DEVELOPING DEVICE, AND IMAGE FORMING APPARATUS AND PROCESS CARTRIDGE INCORPORATING SAME

CROSS-REFERENCE TO RELATED APPLICATIONS

This patent application is based on and claims priority pursuant to 35 U.S.C. § 119(a) to Japanese Patent Application No. 2016-213624, filed on Oct. 31, 2016, in the Japan Patent Office, the entire disclosure of which is hereby incorporated by reference herein.

BACKGROUND

Technical Field

This disclosure generally relates to a developing device, a process cartridge, and an image forming apparatus, such as a copier, a printer, a facsimile machine, or a multifunction peripheral (or multifunction machine) having at least two of copying, printing, facsimile transmission, plotting, and scanning capabilities.

Description of the Related Art

Recently, in electrophotographic image forming apparatuses such as copier and printers, reduction in particle size of toner has been promoted to enhance image quality. As toner particle size is reduced, the point of contact with carrier decreases, and the toner is easily separated from the carrier. Thus, the risk of scattering of toner outside a developing device increases.

Additionally, when a developing roller rotates, outside air is taken into the developing device, and pressure inside the developing device increases. Then, from a portion where pressure release is easy, the pressure is released together with toner floating inside the developing device.

The scattering toner may adhere, in particular, to a casing of the developing device near a photoconductor and accumulate there. Then, it is possible that the accumulating toner drops in an aggregation form upon, for example, vibration of the image forming apparatus. If the toner drops on the photoconductor, the developing roller near the photoconductor, or an intermediate transferor, the toner degrades image quality (image failure by toner drop).

To prevent scattering of toner outside the developing device, there are developing devices that include a scattering prevention sheet to close a gap between a surface of the photoconductor and a rim of a casing enclosing an opening through which the developing roller opposes the photoconductor.

For example, the scattering prevention sheet is disposed upstream from a developing range in the direction of rotation of the developing roller. A first end of the developer scattering prevention sheet is secured to the casing, and a second end of the scattering prevention sheet is disposed in contact with the photoconductor, thereby closing the gap between the photoconductor and the rim of the casing adjacent to the opening.

SUMMARY

According to an embodiment of this disclosure, a developing device includes a casing to contain developer, a developer bearer disposed in the casing and opposite a latent image bearer in a developing range, and the developer bearer is to rotate to supply the developer to the latent image bearer in the developing range. The developing device further includes at least one developer contact face to which the developer adheres in image formation, and a vibrator to give vibration to the developer contact portion in a non-image formation period.

In another embodiment, a process cartridge includes the above-described developing device, and at least one of the latent image bearer, a charging device to charge the latent image bearer, and a cleaning device to clean the latent image bearer. The developing device and the at least one component are united together.

In another embodiment, an image forming apparatus includes the above-described process cartridge and a transfer device to transfer an image developed by the developing device onto a recording medium.

In another embodiment, an image forming apparatus includes the above-described latent image bearer to bear a latent image and the above-described developing, to develop the latent image with the developer.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
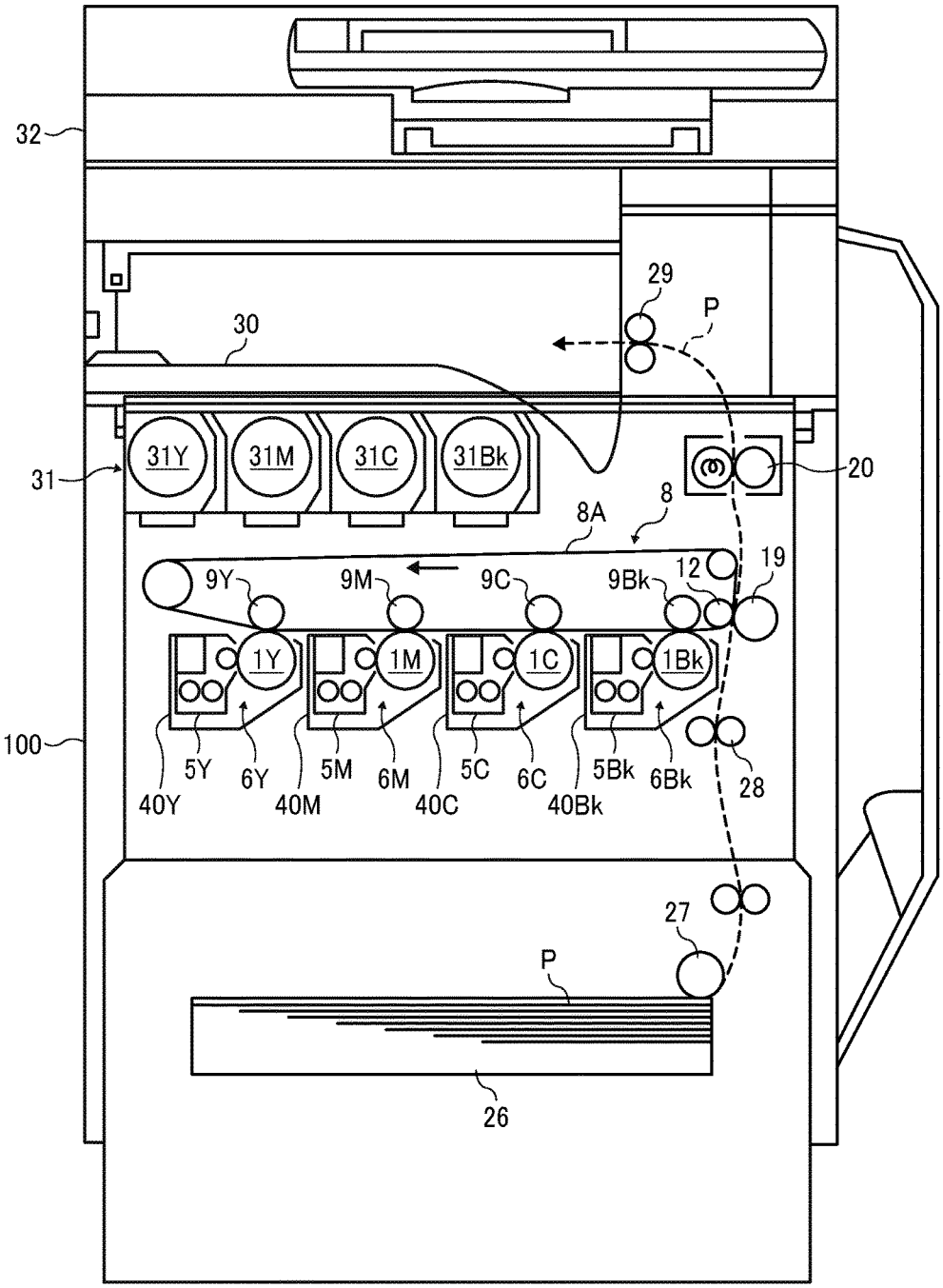
FIG. 1 is a schematic front view of an image forming apparatus according to an embodiment.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, an image forming apparatus according to an embodiment of this disclosure is described. As used herein, the singular forms "a", "an", and "the" are intended to include the plural forms as well, unless the context clearly indicates otherwise.

The suffixes Y, M, C, and K attached to each reference numeral indicate only that components indicated thereby are used for forming yellow, magenta, cyan, and black images, respectively, and hereinafter may be omitted when color discrimination is not necessary.

FIG. 1 is a schematic view of an image forming apparatus that employs a process cartridge including a developing device according to an embodiment of this disclosure. The image forming apparatus illustrated in FIG. 1 is, for example, a tandem multicolor copier and includes an apparatus body 100 and a document reader 32 that reads image data of a document and includes a document feeder to transport the document. The image forming apparatus illustrated in FIG. 1 further includes an output tray 30 on which output images are stacked, a sheet feeding tray 26 containing recording media P (recording media) such as transfer paper sheets, a sheet feeding roller 27 to feed the recording media P one by one from the sheet feeding tray 26, and a registration roller pair 28 to adjust the timing to transport the recording medium P.

The image forming apparatus illustrated in FIG. 1 further includes yellow, magenta, cyan, and black image forming sections 6Y, 6M, 6C, and 6Bk respectively including photoconductor drums 1Y, 1M, 1C, and 1Bk (i.e., image bearers) and developing devices 5Y, 5M, 5C, and 5Bk to develop electrostatic latent images on the photoconductor drums 1Y, 1M, 1C, and 1Bk, primary-transfer bias rollers 9Y, 9M, 9C, and 9Bk to transfer toner images from the photoconductor drums 1Y, 1M, 1C, and 1Bk onto the recording medium P. On the recording medium P, the toner images are superimposed one on another.

The image forming apparatus illustrated in FIG. 1 further includes an intermediate transfer unit 8 including an intermediate transfer belt 8A, serving as an image bearer on which multiple single-color toner images are superimposed one on another, a secondary-transfer bias roller 19 to transfer the superimposed toner image from the intermediate transfer belt 8A onto the recording medium P, a fixing device 20 to fix the toner image on the recording medium P, and a bottle mount 31 to contain toner containers 31Y, 31M, 31C, and 31Bk from which yellow, cyan, magenta, and black toners are supplied to the developing devices 5Y, 5M, 5C, and 5Bk. The primary-transfer bias rollers 9Y, 9M, 9C, and 9Bk and the secondary-transfer bias roller 19 together serve as a transfer device to transfer an image developed by the developing device 5 onto the recording medium P.

Figure 2:
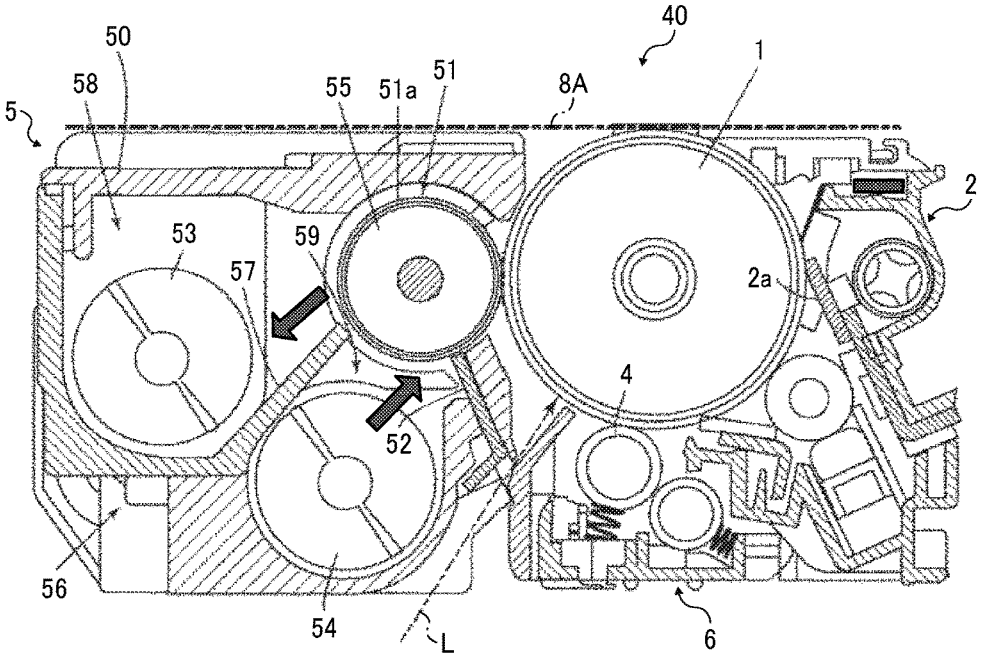
FIG. 2 is a schematic cross-sectional view of a process cartridge according to an embodiment.

As illustrated in FIG. 1, the intermediate transfer unit 8 is disposed in the apparatus body 100. The image forming sections 6Y, 6M, 6C, and 6Bk respectively corresponding to yellow, magenta, cyan, and black are arranged in parallel, facing the intermediate transfer belt 8A of the intermediate transfer unit 8. The four image forming sections 6Y, 6M, 6C, and 6Bk are similar in configuration, an example of which is illustrated in FIG. 2, except the color of the toner used in electrophotographic image formation. In FIG. 2, the reference characters representing the color (Y, M, C, or Bk) are omitted from the image forming section 6, the photoconductor drum 1, and the primary-transfer bias roller 9.

Referring to FIG. 2, the image forming section 6 includes the photoconductor drum 1 (latent image bearer) and further includes a charging device 4, the developing device 5, a cleaning device 2 disposed around the photoconductor drum 1 (only the developing device 5 is illustrated in FIG. 1). In the image forming section 6, toner images are formed on the photoconductor drum 1 through image forming processes, namely, charging, exposure, developing, transfer, and cleaning processes.

The components of the image forming section 6, namely, the photoconductor drum 1, the charging device 4, the developing device 5, and the cleaning device 2 are united into a process cartridge 40. The process cartridge 40 is removably mounted in the apparatus body 100 and replaced when the operational life thereof expires. Note that, in FIG. 1, the reference characters representing the colors are given to the process cartridges 40 (40Y, 40M, 40C, and 40Bk).

When the image forming section 6 is configured as the process cartridge 40 removably mountable in the apparatus body 100, maintenance work and replacement of the image forming section 6 can be facilitated, and recycle thereof can improve.

Operations of the image forming apparatus illustrated in FIG. 1 to form multicolor images are described below. Note that FIG. 2 is also referred in descriptions of image forming process performed on the respective photoconductor drums 1 of the image forming section 6Y, 6M, 6C, and 6Bk.

Conveyance rollers of the document feeder transport documents set on a document table onto an exposure glass (contact glass) of the document reader 32. Then, the document reader 32 reads image data of the document set on the exposure glass optically.

More specifically, the document reader 32 scans the image of the document on an exposure glass with light emitted from an illumination lamp. The light reflected from the surface of the document is imaged on a color sensor via mirrors and lenses. The multicolor image data of the document is read for each color separation light of red, green, and blue (RGB) by the color sensor and converted into electrical image signals. Further, the image signals are transmitted to an image processor that performs image processing (e.g., color conversion, color calibration, and spatial frequency adjustment) according to the color separation image signals of RGB, and thus image data of yellow, magenta, cyan, and black is obtained.

Then, the image data of yellow, magenta, cyan, and black are transmitted to an exposure device, which is, for example, an optical writing device employing laser scanning. The exposure device directs laser beams L (see FIG. 2) to the photoconductor drums 1Y, 1M, 1C, and 1Bk according to the image data of respective colors.

Meanwhile, the four photoconductor drums 1Y, 1M, 1C, and 1Bk rotate clockwise in FIG. 1. Initially, the surface of each photoconductor drum 1 is charged by the charging device 4 (illustrated in FIG. 2) uniformly at a position facing the charging device 4 (a charging process). When the photoconductor drum 1 reaches a portion to receive the laser beam L emitted from the exposure device, the photoconductor drum 1 is scanned with the laser beam L, and thus an electrostatic latent image is formed thereon (an exposure process).

More specifically, the laser beams L according to the respective color image data are emitted from four light sources of the exposure device. The four laser beams L pass through different optical paths for yellow, magenta, cyan, and black.

The photoconductor drum 1Y, which is the first from the left in FIG. 1 among the four photoconductor drums 1, is irradiated with the laser beam L corresponding to the yellow component. A polygon mirror that rotates at high speed deflects the laser beam L for yellow in a direction of a rotation axis of the photoconductor drum 1Y (main scanning direction) so that the laser beam L scans the surface of the photoconductor drum 1Y. Thus, an electrostatic latent image for yellow is formed on the photoconductor drum 1Y charged by the charging device 4.

Similarly, the surface of the photoconductor drum 1M that is the second from the left in FIG. 1 is irradiated with the laser beam L corresponding to the magenta component, thus forming an electrostatic latent image for magenta on the photoconductor drum 1M. The surface of the photoconductor drum 1C that is the third from the left in FIG. 1 is irradiated with the laser beam L corresponding to the cyan component, thus forming an electrostatic latent image for cyan on the photoconductor drum 1C. The surface of the photoconductor drum 1Bk that is the fourth from the left in FIG. 1 is irradiated with the laser beam L corresponding to the black component, thus forming an electrostatic latent image for black on the photoconductor drum 1Bk.

Subsequently, the surface of the photoconductor drum 1 where the electrostatic latent image is formed is further transported to the position facing the developing device 5. Each developing device 5 supplies toner of the corresponding color to the photoconductor drum 1 to develop the electrostatic latent image on the photoconductor drum 1 into a single-color toner image (development process).

Subsequently, the surface of the photoconductor drum 1 reaches a position facing the intermediate transfer belt 8A, serving as the image bearer as well as an intermediate transferor. The intermediate transferor is not limited to a belt but can be a drum. At the positions opposite the photoconductor drums 1Y, 1M, 1C, and 1Bk via the intermediate transfer belt 8A, the primary-transfer bias rollers 9Y, 9M, 9C, and 9Bk are disposed in contact with an inner face of the intermediate transfer belt 8A. At the positions of the primary-transfer bias rollers 9Y, 9M, 9C, and 9Bk, the toner images on the photoconductor drums 1Y, 1M, 1C, and 1Bk are sequentially transferred onto the intermediate transfer belt 8A. The toner images are superimposed one on another on the intermediate transfer belt 8A into a multicolor toner image (primary transfer process). After the primary transfer process, although the amount is small, toner tends to remain untransferred on the photoconductor drum 1.

Subsequently, the surface of the photoconductor drum 1 reaches a position facing the cleaning device 2 (illustrated in FIG. 2). In the cleaning device 2, for example, a cleaning blade 2*a* collects the untransferred toner from the photoconductor drum 1 (a cleaning process). Subsequently, the surface of the photoconductor drum 1 reaches the position opposite the discharger, where the discharger removes residual potentials remaining on the surface of the photoconductor drum 1. Thus, a sequence of image forming processes performed on the photoconductor drums 1Y, 1M, 1C, and 1Bk is completed.

The above-described image forming process is performed on each of the four image forming section 6Y, 6M, 6C, and 6Bk. That is, referring to FIG. 1, the respective photoconductor drums 1 in the image forming sections 6 are irradiated with the laser beams L according to image data, emitted from the exposure device disposed below the image forming sections 6 in FIG. 1. The exposure device includes light sources to emit the laser beams L, multiple optical elements, and a polygon mirror that is rotated by a motor. The exposure device irradiates the photoconductor drums 1 with the laser beams L via the multiple optical elements while deflecting the laser beams L with the polygon mirror. Then, the toner images formed on the photoconductor drums 1 through the above-described developing process are transferred therefrom and superimposed one on another on the intermediate transfer belt 8A. Thus, a full-color (multicolor) toner image is formed on the intermediate transfer belt 8A.

The four primary-transfer bias rollers 9 are pressed against the corresponding photoconductor drums 1 via the intermediate transfer belt 8A, and four contact portions between the primary-transfer bias rollers 9 and the corresponding photoconductor drums 1 are hereinafter referred to as primary transfer nips. To each primary-transfer bias roller 9, a transfer bias opposite in polarity to the toner is applied. While rotating in the direction indicated by the arrow illustrated in FIG. 1, the intermediate transfer belt 8A sequentially passes through the respective primary transfer nips formed by the primary-transfer bias rollers 9Y, 9M, 9C, and 9Bk. Then, the single-color toner images are transferred from the respective photoconductor drums 1 primarily and superimposed one on another on the intermediate transfer belt 8A.

Then, the intermediate transfer belt 8A carrying the multicolor toner image reaches a position facing the secondary-transfer bias roller 19. At that position, a secondary-transfer backup roller 12 and the secondary-transfer bias roller 19 press against each other via the intermediate transfer belt 8A, and the contact portion therebetween is referred to as a secondary transfer nip. The multicolor toner image on the intermediate transfer belt 8A is transferred onto the recording medium P (recording medium) transported to the secondary transfer nip. At this time, there is toner remaining on the intermediate transfer belt 8A, untransferred onto the recording medium P, after the secondary transfer process. The untransferred toner on the intermediate transfer belt 8A is removed by a belt cleaning unit, and thus the intermediate transfer belt 8A is initialized. Thus, a sequence of image forming processes performed on the intermediate transfer belt 8A is completed.

The recording medium P is transported from the sheet feeding tray 26 disposed in a lower portion of the apparatus body 100 to the secondary transfer nip via the sheet feeding roller 27, the registration roller pair 28, and the like. The sheet feeding tray 26 contains multiple recording media (e.g., transfer paper sheets) piled one on another. The sheet feeding roller 27 rotates counterclockwise in FIG. 1 to feed the recording sheet P on the top in the sheet feeding tray 26 toward a nip of the registration roller pair 28. The registration roller pair 28 stops rotating temporarily, stopping the recording medium P with a leading end of the recording medium P stuck in the nip. The registration roller pair 28 rotates to transport the recording medium P to the secondary transfer nip, timed to coincide with the arrival of the multicolor toner image formed on the intermediate transfer belt 8A. Thus, the multicolor toner image is transferred onto the recording medium P.

The recording medium P carrying the multicolor toner image is sent to the fixing device 20. In the fixing device 20, a fixing roller and a pressing roller apply heat and pressure to the recording medium P to fix the multicolor toner image transferred on the surface of the recording medium P. Subsequently, the recording medium P is discharged by an ejection roller pair 29 outside the apparatus body 100 and sequentially stacked as output images on the output tray 30. Thus, a sequence of color image forming processes in the image forming apparatus is completed.

Next, a configuration and operation of the developing device 5 of the image forming section 6 is described in further detail below with reference to FIG. 2.

FIG. 2 is a schematic end-on axial view of the process cartridge 40 used as the image forming section 6. The process cartridge 40 is removably mountable in the image forming section 6 illustrated in FIG. 1. The developing device 5 includes a casing 50 (a developing device casing) to contain developer, a developing roller 51 (a developer bearer,) disposed in the casing 50 and opposite the photoconductor drum 1, a doctor blade 52 (a developer regulator) disposed below the developing roller 51, a developer conveyance compartment 58 (a collecting compartment), a developer conveyance compartment 59 (a supply compartment), and a first conveying screw 53, and a second conveying screw 54. The developer conveyance compartments 58 and 59 are spaces in a vertical arranged in the casing 50. The first and second conveying screws 53 and 54 are disposed in the developer conveyance compartment 58 and the developer conveyance compartment 59, respectively, and serve as developer conveyors to convey and stir the developer therein. The developer conveyors are not limited to screws but can be any structure (e.g., a coil) having a capability to transport developer in the axial direction of the developing roller 51.

Two-component developer including carrier (carrier particles) and toner (toner particles) is contained in the developer conveyance compartment 58 and the developer conveyance compartment 59. The toner used in the present embodiment has shape factors SF-1 and SF-2 both within a range from 100 to 180, for example. The developer conveyance compartment 59 (the supply compartment) is disposed lower than the developing roller 51 and supplies developer to the developing roller 51.

A toner concentration sensor 56 is disposed on the casing 50, at a position facing the first conveying screw 53, to detect toner concentration in the developer. The first conveying screw 53 opposes the developing roller 51 and serves as a collected developer conveyor to mix and stir developer that has left the developing roller 51 with supplied toner. The second conveying screw 54 opposes the developing roller 51 from below the developing roller 51 and serves as a supplied developer conveyor to supply developer to the developing roller 51 while conveying the developer in the longitudinal direction of the developing roller 51. The first and second conveying screws 53 and 54 are configured to rotate in the opposite directions to transport developer in relative directions, thereby circulating the developer in the direction perpendicular to the surface of the paper on which FIG. 2 is drawn.

Figure 3:
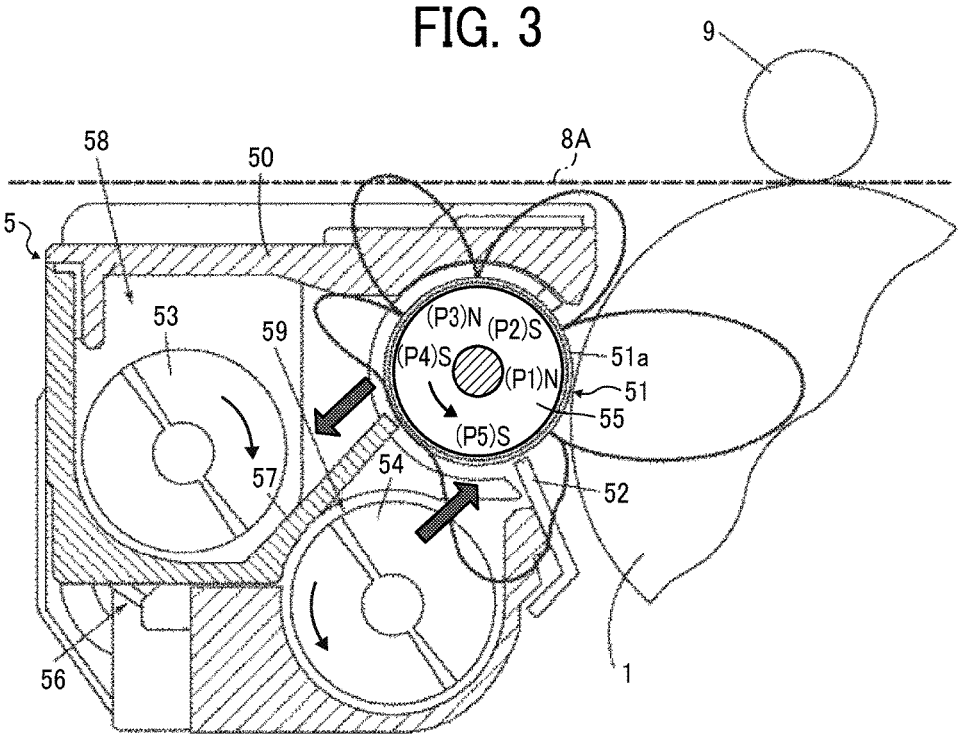
FIG. 3 is a schematic cross-sectional view of a developing device according to an embodiment.
Figure 4:
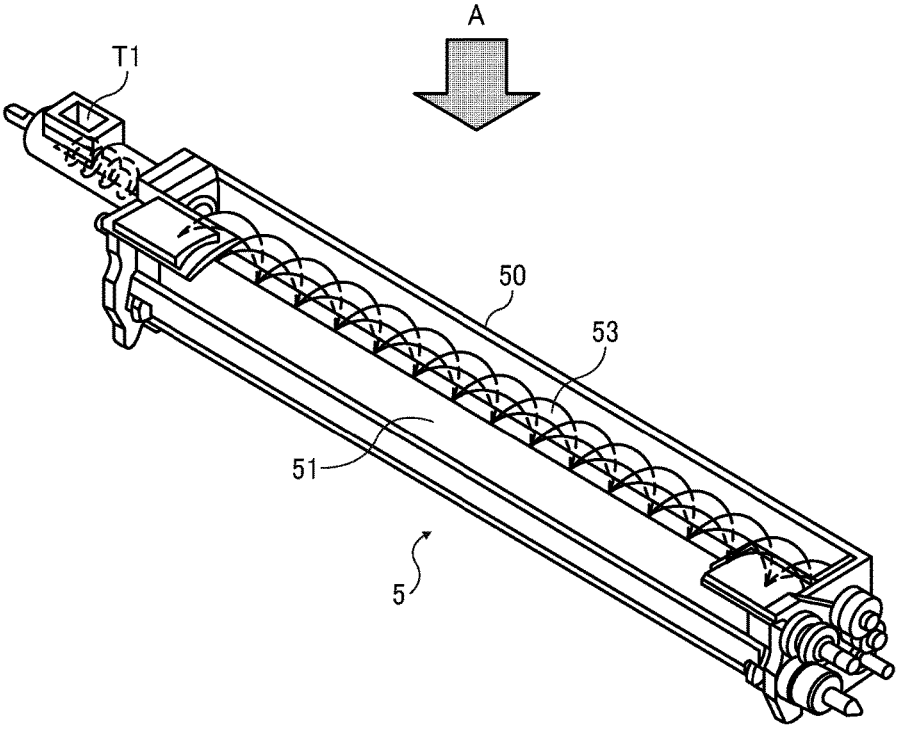
FIG. 4 is a schematic perspective view of the developing device illustrated in FIG. 3.

FIG. 3 is a schematic cross-sectional view of circulation of developer in the developing device 5, and FIG. 4 is a perspective view of the developing device 5 illustrated in FIG. 3. The developing device 5 illustrated in FIGS. 3 and 4 is similar in configuration to that incorporated in the image forming section 6 (process cartridge) illustrated in FIG. 2. As illustrated in FIG. 3, the developing roller 51 includes a magnet roller 55 having multiple stationary magnetic poles and a cylindrical developing sleeve 51*a* that rotates around the magnet roller 55. The magnet roller 55 includes, for example, five magnetic poles P1 through P5. As the developing sleeve 51*a* rotates around the magnet roller 55 having the five magnetic poles, developer moves, carried on the developing sleeve 51*a*, in the circumferential direction (in the direction of arc) of the developing roller 51.

Note that curved lines illustrated in FIG. 3, radiating from the magnet roller 55, represent ranges of magnetic fields (magnetic force) of the magnetic poles P1 through P5. The pole P1 is a main pole to cause developer to stand on end into a magnetic brush in the developing range, the poles P2 and P3 are conveyance poles, the pole P4 is a developer release pole, and the pole P5 is a developer scooping pole.

Note that, although the magnet roller 55 illustrated in FIG. 3 includes the five magnetic poles P1 through P5, the number of the magnetic poles is not limited thereto and is, for example, three, or four or greater than four. Alternatively, instead of the magnet roller 55, multiple stationary magnets are used in another embodiment. The arrangement of polarity, north (N) or south (S), of the magnetic poles P1 through P5 illustrated in FIG. 3 is an example, and the north poles and the south poles can be reversed.

Next, a configuration for unidirectional circulation in the developing device according to the present embodiment is described below.

The developing device 5 illustrated in FIG. 3 includes the developing roller 51, the doctor blade 52, the first conveying screw 53, the developer conveyance compartment 58 (the collecting compartment) containing the first conveying screw 53, the second conveying screw 54 disposed in the developer conveyance compartment 59 (the supply compartment), and a partition 57 to partition, at least partly, the developer conveyance compartments 58 and 59 from each other. The developer conveyance compartments 58 and 59 contains, for example, 300 grams of developer including toner having a particle diameter of about 5.2 μm and carrier magnetic particles (having a particle diameter of about 35 μm). A main ingredient of the toner is polyester resin. In the developer, the toner and the magnetic carrier are mixed uniformly, and the percentage of toner in the developer is about 7% by weight, for example. The first conveying screw 53 and the second conveying screw 54 disposed side by side are rotated at a speed of, for example, about 600 revolutions per minute (rpm), thereby stiffing and transporting the supplied toner simultaneously. Thus, the toner and carrier are mixed uniformly and charged electrically.

While being transported in the longitudinal direction (i.e., the axial direction) by the second conveying screw 54 adjacent to and parallel to the developing sleeve 51*a*, the developer in which toner and carrier are mixed uniformly is attracted by the magnetic force exerted by the pole P5 of the magnet roller 55 onto an outer face of the developing sleeve 51*a*. As the developing sleeve 51*a* rotates in the direction indicated by an arrow in FIG. 3, the developer is transported to the developing range formed by the photoconductor drum 1 and the developing sleeve 51*a*. By a developing electrical field generated by a high-pressure power source, the electrostatic latent image on the photoconductor drum 1 is developed with the toner. As the developing sleeve 51*a* rotates, the developer that has passed through the developing range is collected inside the casing 50 and collected by the first conveying screw 53 downstream from the pole P4 of the magnet roller 55.

Figure 5A:
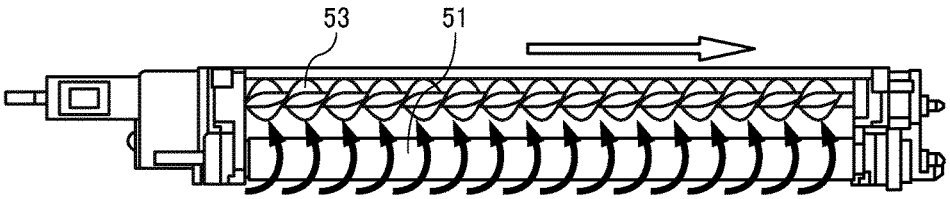
FIGS. 5A, 5B, and 5C are schematic views of the developing device illustrated in FIG. 4.
Figure 5B:
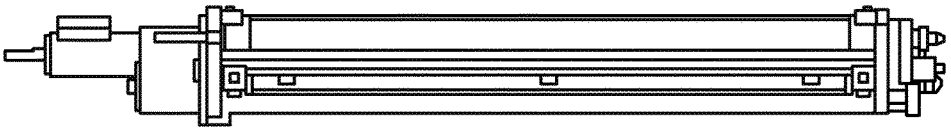
Figure 5C:
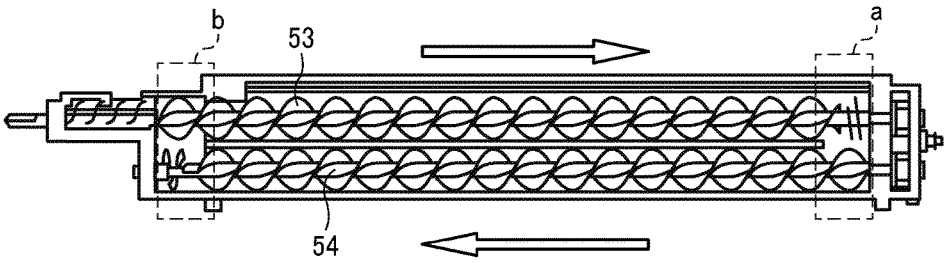

FIGS. 5A, 5B, and 5C are views of the developing device 5 as viewed in the direction indicated by arrow A in FIG. 4, and the casing 50 is omitted in FIGS. 5A, 5B, and 5C for ease of understanding. In FIGS. 5A and 5C, outlined arrows indicate the direction of movement of the developer. FIG. 5A illustrates the movement of developer transported by the first conveying screw 53 when the developer is collected from the developing sleeve 51*a* to the first conveying screw 53. FIG. 5B is a front view of the developing device 5 illustrated in FIG. 5A.

FIG. 5C illustrates movement of the developer transported by the first and second conveying screws 53 and 54 in the developer conveyance compartments 58 and 59 illustrated in FIG. 3. In FIGS. 5A through 5C, the developer conveyance compartments 58 and 59 vertically communicate with each other in end areas a and b, which are at axial ends of the first and second conveying screws 53 and 54. The developer is transported downward in the end area a and transported upward in the end area b. A paddle or a reversed spiral blade is disposed in the end areas a and b to transport the developer in the direction perpendicular to the developer conveyance direction indicated by the outlined arrows. In other words, the developing device 5 includes communicating portions at both longitudinal ends of the two compartments to circulate developer inside the developing device 5.

Figure 6:
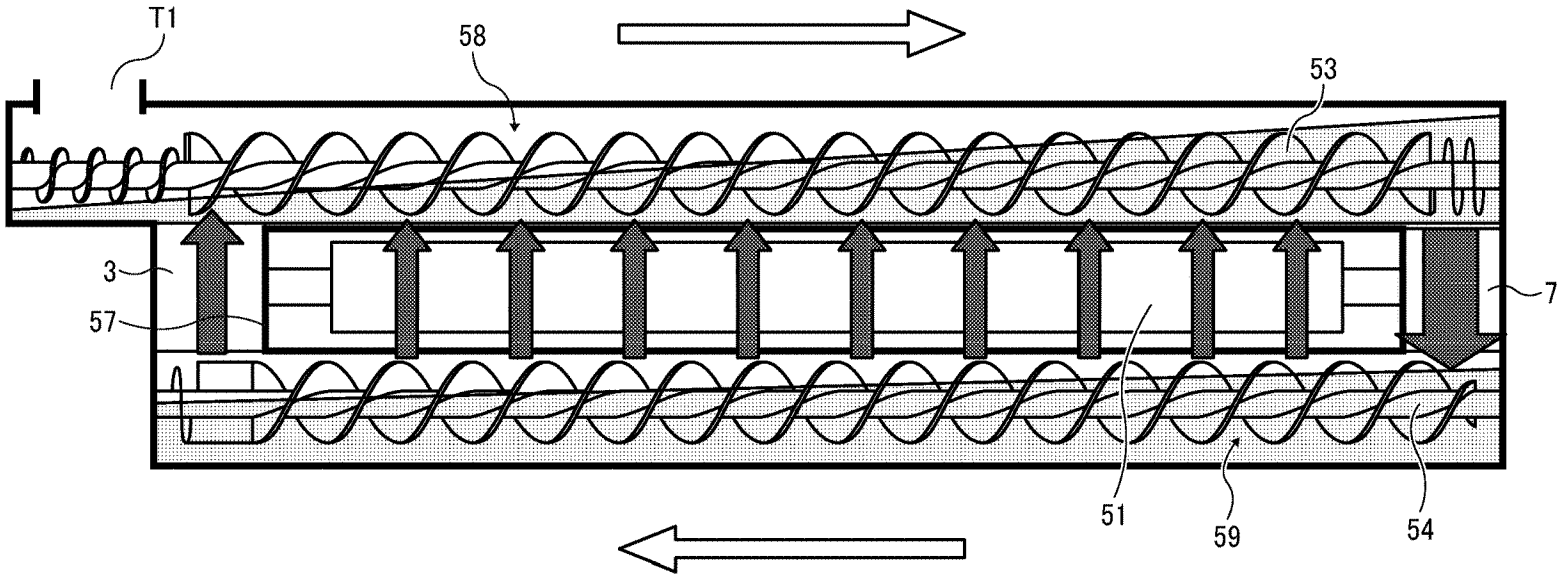
FIG. 6 is a schematic view of flow of toner in the developing device illustrated in FIG. 4.

FIG. 6 is a schematic diagram illustrating movement of developer in the longitudinal direction inside the developing device 5 illustrated in FIGS. 3 and 4.

In the developer conveyance compartment 59, the second conveying screw 54 transports developer in the direction indicated by an arrow illustrated in FIG. 6, and a part of developer transported by the second conveying screw 54 is scooped onto the developing sleeve 51*a* by the magnetic force of the developing roller 51.

The developer that has passed through the developing range is separated from the developing sleeve 51*a* and collected in the developer conveyance compartment 58 in which the first conveying screw 53 is disposed. The partition 57 is partly absent outside the developing range of the developing roller 51 so that the developer conveyance compartments 58 and 59 communicate with each other in communicating portions 3 and 7. The developer transported by the second conveying screw 54 but is not used in image development is transported from the communicating portion 3 on the downstream side in the developer conveyance direction by the second conveying screw 54, indicated by an arrow, to the developer conveyance compartment 58, where the first conveying screw 53 is positioned.

As illustrated in FIGS. 4 and 6, in the developer conveyance compartment 58, a toner supply inlet TI is disposed outside a range of a spiral blade (for conveying developer) of the first conveying screw 53. The toner is supplied from the toner supply inlet TI and conveyed by the first conveying screw 53. The first conveying screw 53 mixes the supplied toner with the developer transported from the second conveying screw 54, and the mixture is transported while being stirred. The developer transported by the first conveying screw 53 includes the developer collected from the developing roller 51 downstream from the developing range. In the communicating portion 7 on the downstream side in the developer conveyance direction in the developer conveyance compartment 58, the developer transported by the first conveying screw 53 is sent to the developer conveyance compartment 59.

As described above, in the developing device 5 in which aspects of this disclosure are adoptable, the first and second conveying screws 53 and 54 transport the developer unidirectionally. While being transported unidirectionally, the developer is supplied to the developing roller 51, collected from the developing roller 51, and mixed with supplied toner.

Embodiment 1 is described below with reference to FIG. 7.

In Embodiment 1, a support 61 is attached to an outer wall of the casing 50 supporting the doctor blade 52. To the support 61, a based end (i.e., a second end) of a scattering prevention sheet 60, serving as a sealing sheet to prevent developer scattering, is attached. In the direction of rotation of the developing roller 51 indicated by arrow Y1 in FIG. 7, the scattering prevention sheet 60 is disposed upstream from the developing range where the developing roller 51 is opposite the photoconductor dorm 1 through the opening. The scattering prevention sheet 60 is flexible and made of an elastic material such as polyurethane resin and polyethylene terephthalate. In the axial direction of the developing roller 51, the length of the scattering prevention sheet 60 is similar to the length of the developing roller 51. A free end (i.e., a first end, specifically an edge or an end face) of the scattering prevention sheet 60 is in contact with the surface of the photoconductor drum 1 that rotates clockwise in the drawing.

This structure inhibits the developer supplied from the developing device 5 onto the photoconductor drum 1 from scattering out the casing 50, thus inhibiting the occurrence of image failure.

Figure 7:
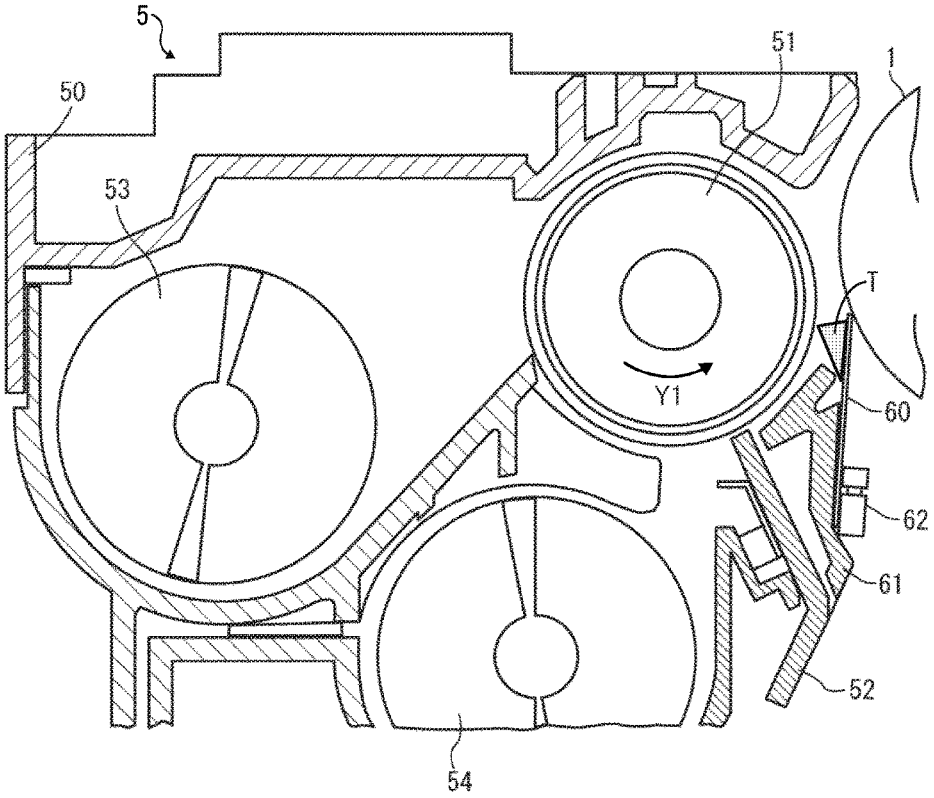
FIG. 7 is a schematic end-on axial view of a developing device according to Embodiment 1.

However, during image forming operation, the toner supplied to the photoconductor drum 1 may accumulate near the free end of the scattering prevention sheet 60 as indicated by reference "T" in FIG. 7. If the accumulated toner T falls on the developing roller 51 or the exposure device due to vibration during the image forming operation, image failure occurs.

To prevent such an inconvenience, in Embodiment 1, a vibrator 62 to give vibration to the scattering prevention sheet 60 is attached to the support 61. As the support 61 vibrates, the vibration is transmitted to the scattering prevention sheet 60. That is, the vibrator 62 indirectly vibrates the scattering prevention sheet 60. The vibration of the scattering prevention sheet 60 vibrates the toner T to fall, thereby dissolving the accumulation of toner T.

In the above-described structure, if the vibrator 62 is attached directly to the scattering prevention sheet 60, the scattering prevention sheet 60 sags down due to the weight of the vibrator 62. Consequently, a clearance is created between the scattering prevention sheet 60 and the photoconductor drum 1, allowing the toner to scatter from the clearance. Then, the function of the scattering prevention sheet 60 is not attained. Therefore, the vibrator 62 is attached to the support 61.

In Embodiment 1, the vibrator 62 is a motor, and a driving source is supplied to the motor via a connector from the apparatus body 100. The vibrator 62 is configured to operate for, for example, a period of 0.5 second after the image forming operation completes.

Vibrating the scattering prevention sheet 60 in an idle time (non-image formation period) is advantageous in inhibiting the occurrence of image failure called "banding" appearing as a streak of image density unevenness in an output image.

The above-described vibration removes the toner T adhering to the scattering prevention sheet 60 that is not in the form of aggregation, from the scattering prevention sheet 60. The removed toner moves onto the developing roller 51 or the photoconductor drum 1. As the developing roller 51 rotates, before the image forming operation, the toner T on the side of the developing roller 51 is collected into the casing 50 and stirred by the first conveying screw 53. Thus, the image failure caused by toner dropping on the photoconductor drum 1 is prevented. By contrast, the toner T on the side of the photoconductor drum 1 is collected by the cleaning device 2 as the photoconductor drum 1 rotates, before the image forming operation. Thus, the image failure caused by toner dropping on the photoconductor drum 1 is prevented.

As a variation of Embodiment 1, instead of the motor, a mechanism employing a spring can be used as the vibrator 62. In this case, during the idle time (non-image formation period), for example, the developing roller 51 is rotated in reverse to turn on and off the tapping of the vibrator employing the spring. Specifically, the mechanism includes a one-way clutch to compress the spring and a knock pin (a tapping member) to tap the scattering prevention sheet 60. The clutch compresses the spring to cause a gear to run idle in normal rotation of the developing roller 51 and rotate only when the developing roller 51 rotates in reverse. The mechanism releases the compressed spring at one burst to cause the knock pin to tap the scattering prevention sheet 60. Subsequently, the developing roller 51 rotates in the normal direction in the non-image formation period to collect the toner T on the side of the developing roller 51 into the casing 50 as described above.

In such a configuration, effects similar to those attained by Embodiment 1 can be attained.

Embodiment 2 is described below with reference to FIG. 8.

In Embodiment 2, in the axial direction of the developing roller 51, a length 60L (width) of the scattering prevention sheet 60 and a length 61L of the support 61 are longer than a length 51L (width) of the developing roller 51, and the vibrator 62 is disposed to vibrate portions (i.e., projecting portions) of the scattering prevention sheet 60 and the support 61 extending beyond the developing roller 51 in the axial direction. That is, the vibrator 62 is disposed in an end portion of the developing device 5 outside the area of the developing roller 51 in the axial direction of the developing roller 51.

To make the image forming apparatus compact, the vibrator 62 preferably fits in a small space. However, placing the vibrator 62 between the developing device 5 and the photoconductor drum 1 becomes difficult as the process cartridge 40 is reduced in size.

Figure 8:
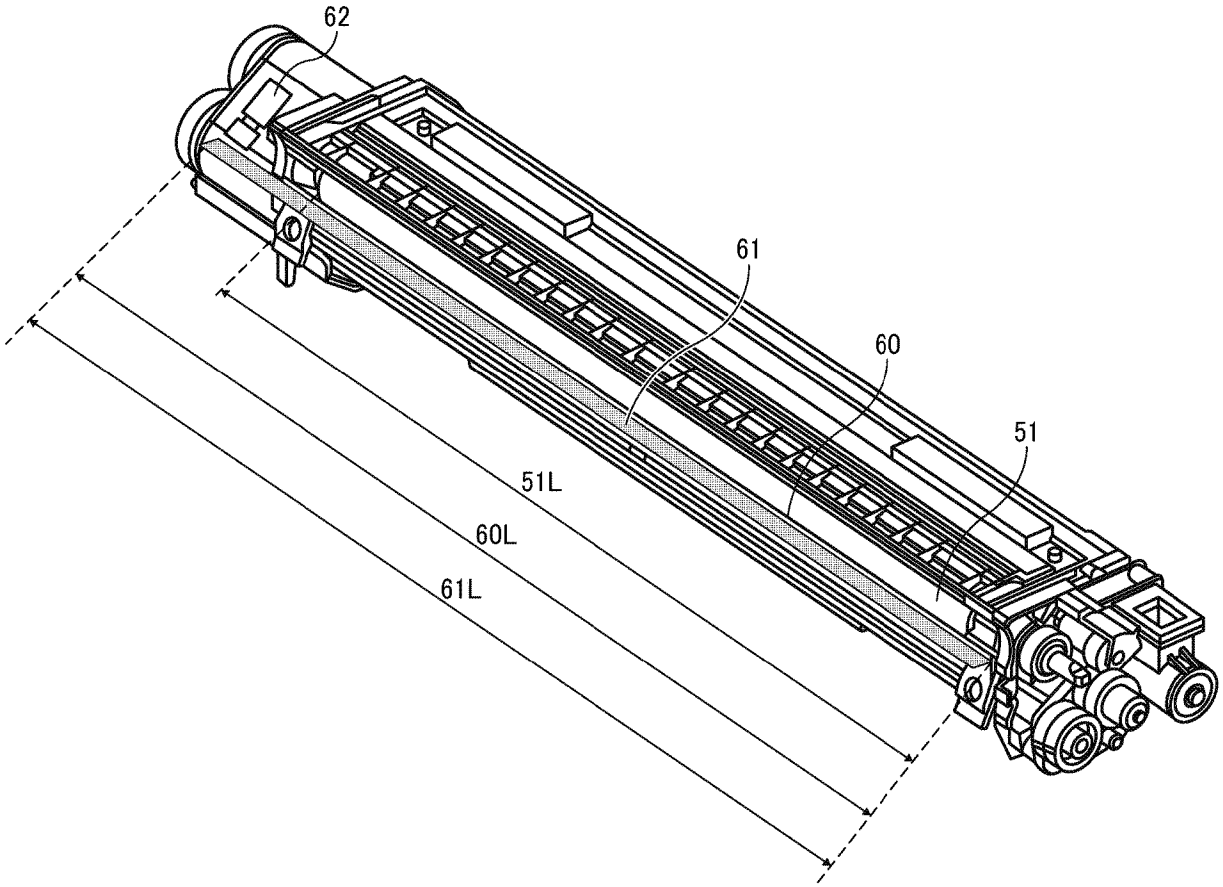
FIG. 8 is a schematic perspective view of a developing device according to Embodiment 2.

Therefore, the arrangement illustrated in FIG. 8 is employed. If the vibrator 62 is attached to the end portion of the scattering prevention sheet 60 extending beyond the developing roller 51 in the longitudinal direction of the developing roller 51, the scattering prevention sheet 60 sags down due to the weight of the vibrator 62 or the weight thereof. Then, even if the vibrator 62 is vibrated, the vibration is not transmitted to the scattering prevention sheet 60. Therefore, the vibrator 62 is disposed near the projecting portion of the support 61 extending beyond the developing roller 51 in the longitudinal direction. Space for the vibrator 62 is available close to the projecting portion of the support 61. Then, the vibration is transmitted via the support 61 to the scattering prevention sheet 60 and further to the toner T thereon. Accordingly, with the vibration, the toner T is removed from the scattering prevention sheet 60.

According to Embodiment 2, even in compact image forming apparatuses, while the function of the scattering prevention sheet 60 is maintained, the toner T adhering to the scattering prevention sheet 60 can be removed by vibration. Thus, action and effects similar to those attained by Embodiment 1 can be attained.

Embodiment 3 is described below with reference to FIG. 9.

In Embodiment 3, the vibrator 62 is disposed in an upper portion of the casing 50. In FIG. 9, an opposing face 50*a* of the casing 50 opposes the developing roller 51, and the vibrator 62 gives vibration, mainly, to the opposing face 50*a*. The vibrator 62 is similar in structure to that in Embodiment 1.

This structure can drop the toner T on the opposing face 50*a* of the casing 50 to remove the toner T therefrom. As the casing 50 is vibrated to remove the toner T therefrom during the non-image formation period, drop of the toner T during image formation can be prevented.

The vibration is further given to an opposing face 50*b* of the casing 50 opposing the photoconductor drum 1, and the toner T adhering to the opposing face 50*b* drops by the vibration. Thus, the toner T is removed from the opposing face 50*b*. The removed toner T is collected by the cleaning device 2 as the photoconductor drum 1 rotates, before the image forming operation. Thus, the image failure caused by toner dropping is prevented. The opposing faces 50*a* and 50*b* are developer contact faces located on the upstream side from the developing range in the direction of rotation of the developing roller 51.

Figure 9:
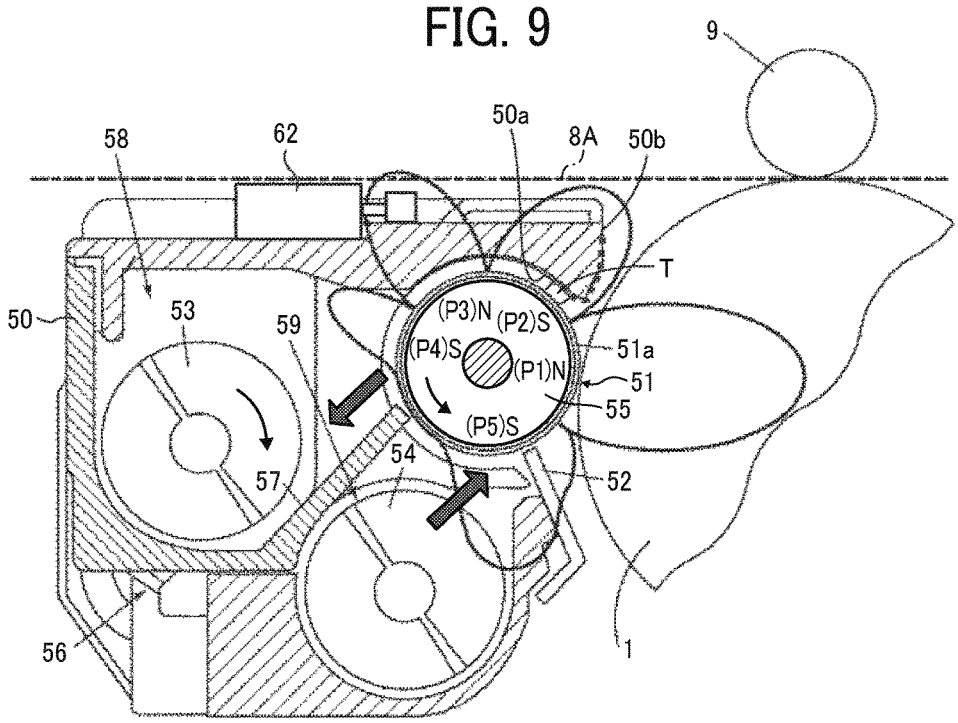
FIG. 9 is a schematic end-on axial view of a developing device according to Embodiment 3.

Although, in Embodiment 3, the vibrator 62 is attached to the upper side of the casing 50 in FIG. 9 to vibrate the casing 50 in a vertical direction, the location of the vibrator 62 is not limited thereto as long as sufficient vibration of the casing 50 is attained. For example, the vibrator 62 can be attached to the left side, the front side, or the rear side of the casing 50 in FIG. 9 to vibrate the casing 50 to drop the toner T. Note that, in Embodiment 3, the casing 50 is formed of a plurality of divided parts, and the divided parts are identical in material.

Although the vibration is given after the completion of image formation in the description above, similar effects can be attained when the vibration is given before image formation, specifically, before the start of an initial action of the image formation.

Similar to the variation of Embodiment 1, as the vibrator 62, a mechanism employing a spring can be used.

Embodiment 4 is described below with reference to FIG. 10. Differently from Embodiment 3, in Embodiment 4, the developing device includes a separate lid 49 different in material from a casing 501 (i.e., a containing portion of the casing) containing the first conveying screw 53 and the second conveying screw 54. The separate lid 49 includes an opposing face 49*a* disposed opposing the developing roller 51, and the toner T adheres to the opposing face 49*a*. The casing 501 serves as a containing portion of the casing 50, and the separate lid 49 serves as a separate component attached to the containing portion.

The vibrator 62 preferably fits in a small space to make the image forming apparatus compact, which is a trade-off for applying a strong vibration. The vibration from a vibration source becomes stronger as the capacity and the weight of a vibrated part are smaller than the capacity and the weight of the casing 501 containing the first conveying screw 53 and the second conveying screw 54. Accordingly, in Embodiment 4, the separate lid 49 is used as the upper portion of the casing 50 illustrated in FIG. 9, and vibration is given to the separate lid 49. To prevent leak of toner, a sealing member such as sponge is interposed between the separate lid 49 and the casing 501.

This structure is advantageous in that accumulating toner can drop upon a weak vibration and the occurrence of image failure is prevented. The vibration is further given to an opposing face 49*b* of the separate lid 49 opposing the photoconductor drum 1, and the toner T adhering to the opposing face 49*b* drops by the vibration. Thus, the toner T is removed from the opposing face 49*b*. The removed toner T is collected by the cleaning device 2 as the photoconductor drum 1 rotates, before the image forming operation. Thus, the image failure caused by toner dropping is prevented.

Figure 11A:
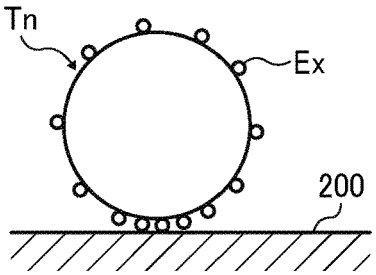
FIGS. 11A and 11B are schematic views illustrating repellency to adhesion of developer in Embodiment 5.
Figure 11B:
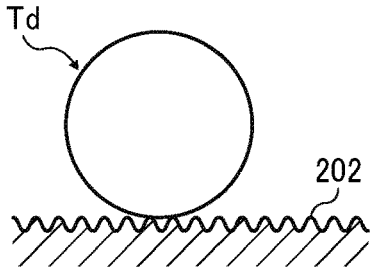

FIGS. 11A and 11B are schematic views illustrating a face having repellency to adhesion of developer, according to Embodiment 5.

FIG. 11A illustrates a fresh toner particle Tn (having external additives Ex) on a smooth surface 200. FIG. 11B illustrates a degraded toner particle Td on a surface having minute roughness 202. As illustrated in FIG. 11A, typically the surface of the fresh toner particle Tn is rugged due to external additives Ex on the surface thereof. With elapse of time, the toner is degraded to the degraded toner particle Td illustrated in FIG. 11B, and the external additives Ex are liberated or buried. Then, the surface of the degraded toner particle Td becomes smoother, thereby increasing the area of contact between the degraded toner particle Td and the components of the developing device.

Figure 10:
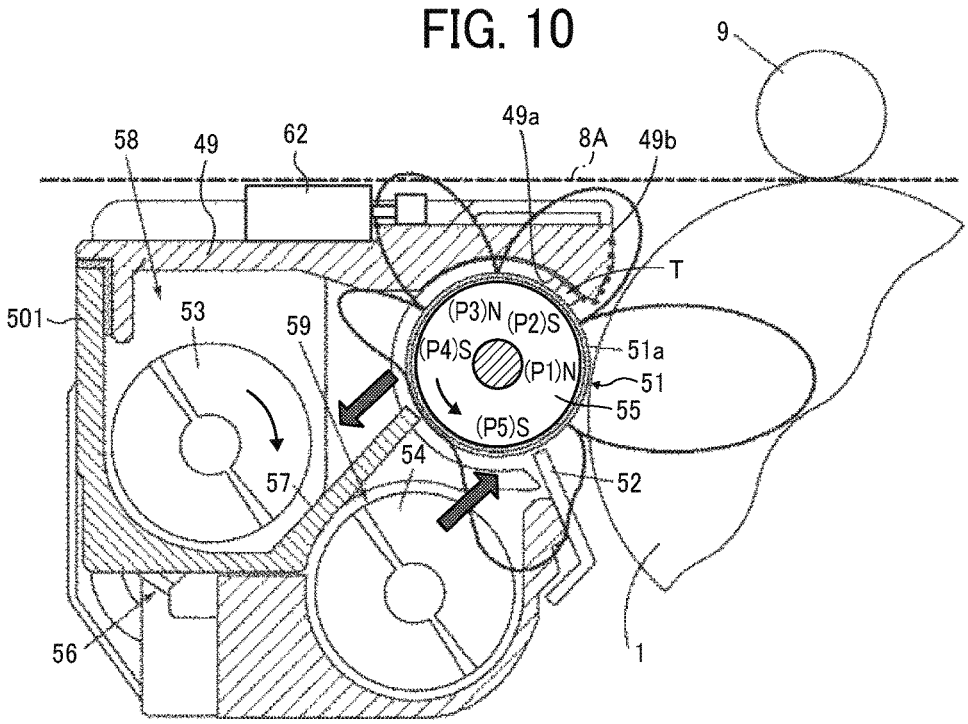
FIG. 10 is a schematic end-on axial view of a developing device according to Embodiment 4.

The opposing faces 49*a* and 50*a* and the like illustrated in FIGS. 9 and 10 are made of a material having repellency to adhesion of developer (hereinafter "developer-adhesion repellent sheet"), such as a sheet of TOYAL LOTUS®. The developer-adhesion repellent sheet can be bonded to the face of the casing 50 to construct the opposing face 49*a*, 49*b*, 50*a*, or 50*b*. The developer-adhesion repellent sheet makes a non-electrostatic adhesive force acting between the toner T and the opposing faces 49*a* and 50*a* smaller than that acting between the toner and the face of the casing 501 containing the first conveying screw 53 and the second conveying screw 54. TOYAL LOTUS™ has surface unevenness made by nano-order projections (or recesses) shaped like lotus leaves. TOYAL LOTUS™ is water repellent and significantly reduces the force of adhesion of toner. The material having repellency to adhesion of developer is not limited to the description above but includes examples mentioned in U.S. Pat. No. 9,594,332-B2, which is hereby incorporated by reference herein.

Not limited to bonding of the sheet, the nano-order projections (or recesses) can be produced by spraying or dipping. Alternatively, the surface of the component can be made by nano printing. In the structure in which the opposing faces 49*a* and 50*a* have repellency to adhesion of toner, the toner easily falls upon vibration, and effect to prevent flocculation of toner is enhanced.

Repellency to adhesion of developer is described below.

The uneven surface repellent to developer has a surface roughness Ra greater than 25 nm in a length of 2 μm measured by a scanning probe microscope (SPM). The surface roughness Ra can be measured as follows, using a scanning probe microscope system, SPA400, from Seiko Instruments Inc. After a sample area of 10 $\mu m^2$ is scanned in dynamic force mode (DFM) or tapping mode, inclination is corrected, and measurement is executed with a measurement length of 2 μm, without cutoff. Since typical toner particle diameter for electrophotographic image forming apparatuses is 2 μm to 10 μm, it is assumed that the measurement length of 2 μm is sufficient for considering the interface of contact between the toner and the material. Then, the surface unevenness can be measured in the minute range that contacts toner. The surface unevenness is measured 10 times at different positions, and an average of measured values is used.

According to the above-described measurement method, TOYAL LOTUS™ used in the present embodiment has a surface roughness Ra of 45 nm.

Regarding the surface roughness Ra with the measurement length of 2 μm, measured by the scanning probe microscope, there is no theoretical upper limit of the range that is repellent to developer. However, if projections and recesses on the surface are too large in size, in practice, the measurement values are different from true roughness because the probe of the scanning probe microscope fails to follow the roughened surface. Note that the state where the surface roughness Ra with the measurement length of 2 μm is large means that amplitudes in the depth direction of projections and recesses are large. According to Japanese Industrial Standards (JIS), an applicable range of surface roughness Ra to be measured by scanning probe microscopes is 1 nm to 30 nm.

Although the measurement length is fixed to 2 μm in the measurement method described here and does not comply with JIS, a problem that the probe fails to follow the surface roughness is common to the measurement method described here and that according to JIS. Therefore, although the lower limit of the surface roughness Ra with the measurement length of 2 μm is 25 nm, the upper limit is not set.

Although transfer paper sheet is mentioned as an example of the recording medium P in the embodiments described above, the recording medium on which an image is formed is not limited thereto but also includes thick paper, a postcard, an envelope, plain paper, thin paper, coated paper, art paper, tracing paper, and the like. In addition to paper, the recording medium further includes any sheet, such as overhead transparencies (OHP sheets or OHP film), and resin film, on which an image can be formed.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

What is claimed is:

1. A developing device comprising:

a casing to contain developer;

a developer bearer, disposed in the casing and disposed opposite a latent image bearer in a developing range, to rotate to supply the developer to the latent image bearer in the developing range;

at least one developer contact face, the developer being configured to adhere to the at least one developer contact face in image formation;

a vibrator to give vibration to the at least one developer contact face in a non-image formation period;

a sealing sheet, disposed adjacent to the developer bearer, including a first end disposed in contact with a surface of the latent image bearer and including the at least one developer contact face on an upstream side from the developing range, in a direction of rotation of the developer bearer; and a support, including an end secured to the casing, to support a second end of the sealing sheet, opposite the first end of the sealing sheet, wherein the sealing sheet and the support are relatively longer than the developer bearer, in an axial direction of the developer bearer, and wherein the vibrator is configured to vibrate a projecting portion of the support, projecting beyond the developer bearer in the axial direction, to give vibration to the sealing sheet.

2. The developing device according to claim 1, wherein the casing includes the at least one developer contact face, wherein the at least one developer contact face is an opposing face disposed opposing the developer bearer and disposed downstream from the developing range in a direction of rotation of the developer bearer, and wherein the vibrator is to give the vibration to the opposing face.

3. The developing device according to claim 2, further comprising a developer conveyor to convey the developer inside the casing, wherein the casing includes:

a containing portion to contain the developer conveyor; and a separate component disposed adjacent to the developer bearer and attached to the containing portion, wherein the separate component includes the opposing face.

4. The developing device according to claim 2, wherein the opposing face has repellency to adhesion of developer.

5. A process cartridge comprising:

the developing device according to claim 2; and at least one of the latent image bearer, a charging device, and a cleaning device, united together with the developing device, wherein the charging device is to charge the latent image bearer, and the cleaning device is to clean the latent image bearer.

6. An image forming apparatus comprising:

the process cartridge according to claim 5; and a transfer device to transfer an image developed by the developing device onto a recording medium.

7. An image forming apparatus comprising:

the latent image bearer to bear a latent image; and the developing device according to claim 2, to develop the latent image with the developer.

8. A process cartridge comprising:

the developing device according to claim 1; and at least one of the latent image bearer, a charging device, and a cleaning device, united together with the developing device, wherein the charging device is to charge the latent image bearer, and the cleaning device is to clean the latent image bearer.

9. An image forming apparatus comprising:

the process cartridge according to claim 8; and a transfer device to transfer an image developed by the developing device onto a recording medium.

10. An image forming apparatus comprising:

the latent image bearer to bear a latent image; and the developing device according to claim 1, to develop the latent image with the developer.

* * * * *